US005435967A

United States Patent [19]

Nishikawa et al.

[11] Patent Number: 5,435,967

[45] Date of Patent: Jul. 25, 1995

[54] METHOD OF PREPARING AN AIR-PERMEABLE MOLDED BODY

[75] Inventors: Kazuyuki Nishikawa, Toyohashi; Naoshi Makiguchi, Aichi; Masato Kawamura, Toyohashi, all of Japan

[73] Assignee: Sintokogio, Ltd., Aichi, Japan

[21] Appl. No.: 229,918

[22] Filed: Apr. 19, 1994

[30] Foreign Application Priority Data

Oct. 15, 1993 [JP] Japan ..... 5-281647

[51] Int. Cl.[6] ..... B22F 1/00

[52] U.S. Cl. ..... 419/65; 419/66

[58] Field of Search ..... 419/65, 66

[56] References Cited

U.S. PATENT DOCUMENTS 5,261,478 11/1993 Sun ..... 164/137

5,270,364 12/1993 Schwartz et al. ..... 524/106

FOREIGN PATENT DOCUMENTS 60-46213 4/1983 Japan .

61-67703 9/1984 Japan .

5-163506 12/1991 Japan .

*Primary Examiner*—Donald P. Walsh

*Assistant Examiner*—Anthony R. Chi

*Attorney, Agent, or Firm*—Fish & Neave; Edward Etkin

[57] ABSTRACT

The present invention provides a method of preparing a molded body good in processing properties, having fine contiguous pores throughout it. The surface texture of the body is fine. The body is excellent in thermal conductivity and heat-resistance properties, can be readily prepared, and is usable as a transferring mold.

The method comprises compounding and mixing 5–20 parts by weight of a binder consisting of a modified amine and a modified M. D. I. that are both liquid with 100 parts by weight of an aggregate consisting of aluminum powders or aluminum-based alloy powders, filling the mixture in a molding flask, and compressing it under a pressure per unit area of 20–80 kg/cm$^2$, and maintaining it under the same pressure until the binder is hardened.

1 Claim, 1 Drawing Sheet

METHOD OF PREPARING AN AIR-PERMEABLE MOLDED BODY

BACKGROUND OF THE INVENTION

1. A Field of the Invention

This invention relates to a method of preparing a molded body (mold and mold material) at a low cost, which body has air permeability throughout it, good thermal conductivity and heat resistance, and easy workability.

2. Prior Art

Conventionally, forming molds having air permeability, and good thermal conductivity and heat-resistance, has been widely used to mold a thermoplastic plastic by the vacuum-forming method. The reason why the molds are required to have air permeability as stated above is that they are subjected to a vacuum suction. The reason why they are required to have thermal conductivity is that they themselves are heated in order to improve moldability, and that they themselves are cooled in order to quicken the release of the molded product from them. The reason why they are required to have heat resistance is that the their temperatures are increased in order to improve moldability and that when materials that have high molding temperatures or that are thick are molded, the heat of the material is transferred to the molds to increase their temperatures.

Generally the following are known as the methods of preparing molds and mold materials: (1) a method of making pores for breathing after a metal material is molded, (2) a method of mixing metal powders with ceramic powders by means of an evaporable binder, forming a mold from the mixture, and then sintering the mold in an oxidative atmosphere to evaporate the binder to make the entire mold porous (Japanese Patent Early-publication No. 60-46213), (3) a method of mixing metal powders with a binder, forming a mold from the mixture, and oxidatively sintering the mold to oxidatively bind the metal powders and make the entire mold porous (Japanese Patent Early-publication No. 61-67703), and (4) a method of mixing aluminum powders with an urethane-based binder as a primary binder to form a material in a wet state, injecting a hardening gas as a catalyst into the material to form a primary hardened molded body while subjecting the material to pressure molding, impregnating the molded body with a thermosetting phenolic solution as a secondary binder, drying the impregnated body, curing (secondary hardening) the dried body to obtain a porous mold material, and then processing the cured body to form an air-permeable mold (Japanese Patent Early-publication No. 5-163506), etc.

However, method (1) has such problems as wherein the traces of the processed pores are transferred to the molded workpiece, as well as wherein the method takes many processes to form a mold and to make the mold porous. Also, methods (2) and (3) have such problems as wherein since an oxidatively sintered body is obtained, the methods require much energy for sintering, and as wherein since a ceramic is formed, thermal conductivity is poor, and as wherein processing and modifying a mold is difficult. Method (4) has such a problem as wherein, although the molds obtained by it have good air permeability and thermal conductibity, the method is cumbersome since two kinds of binders are used for hardening, and as wherein since when the mold is secondary cured a phenolic resin is bled on the surface of the mold and is hardened there, the obtained mold cannot be used as it is and it is required that the surface of the mold be processed, and thus it cannot be used as a trasferring mold that transfers a fine pattern.

The present invention was made in consideration of the above problems. It aims at providing a method of producing a mold or mold material (below it will be referred as a molded body) with excellent properties. First, it has fine and contiguous pores throughout the mold and a finely-textured surface; second, it has good thermal conductivity and heat resistance; third, it can be easily prepared and at low cost, fourth, it can be used as a transferring mold and the processability is good; fifth, it has a strength sufficient for use as a mold for vacuum molding, etc.

SUMMARY OF THE INVENTION

To attain the above object the method of preparing an air-permeable molded body by the present invention is characterized by compounding 5–20 parts by weight of a binder consisting of a modified diamine and a modified M. D. I. that are both liquid with 100 parts by weight of an aggregate consisting of aluminum powders or aluminum-alloy powders having a grain size distribution of 325 to 48 mesh, mixing the compound, filling a molding flask with the mixture, compressing the packed mixture under a pressure per unit area of 20–80 kg/cm$^2$ and maintaining the mixture in the compressed state to harden the binder, and thereby obtaining a porous body having many fine and contiguous pores throughout it.

DETAILED DESCRIPTION

Below the present invention will be explained in detail. As the aggregate, aluminum powders or aluminum-alloy powders are used in order to improve thermal conductivity, to reduce weight, and to improve processability. As the binder to obtain a molded body, use is made of a resin prepared by the combination of a modified diamine and a modified M. D. I., featured by an urea reaction, to satisfy the requirements for the obtained molded body having sufficient strength and heat resistance and for a short time needed until the binder is hardened. Since the urea reaction proceeds very quickly, the molded body is rapidly hardened to shorten the dwell period in a molding flask. A modified diamine having a rather high molecular weight, about 1,300, is adopted, considering the fact that when a usual modified diamine with a modified M. D. I. is used the reaction proceeds so rapidly that hardening starts while the binder is being mixed with the aggregate, and thus a good product cannot be obtained by compressing the mixture in a molding flask, and considering the need to confer a sufficient strength, toughness, and heat resistance (to a heat of about 250° C.) to a molded body.

If the grain size of the aggregate is very fine, the texture of the surface of a mold becomes fine and thus when the mold is used as a transferring mold it shows excellent transferability, and when it is used as a processing mold excellent plane properties can be expected. However, since if too fine grains are used, pores among the grains become too small to have good air permeability, aggregates having a grain size distribution of 325 to 48 mesh are adopted.

If the amount of the binder based on that of the aggregate is too small, the strength of the molded body becomes too low for use as a mold, while if it is too much, the binder tends to fill the spaces among the aggregate grains and thus good air permeability cannot be expected, which air permeability also depends on a compressive force as explained below. Thus the binder is compounded in an amount of 5–20 parts by weight based on 100 parts by weight of the aggregate.

If the compressive force is too low, the strength of a molded body becomes low, the properties of the surface of the body get worse, the texture of the surface becomes less fine, and thus the body becomes unsuitable. If the pressure is higher, the strength gets higher and the fineness of the surface texture increases. However, if the force is too high, the spaces among the aggregate ingredients get too small to have good air permeability. Thus the compression is conducted under a pressure per unit area of 20–80 kg/cm$^2$.

EXAMPLE 1

6.6 parts by weight of a modified diamine (UX-1026A, produced by Ace-Kaken Co., Ltd.) was added as the binder to, and mixed with, as the aggregate, 100 parts by weight of aluminum powders having a grain size distribution of 250 to 80 mesh. 3.3 parts by weight of a modified M. D. I. (UX-1026B, prepared by Ace-Kaken Co., Ltd.) was sufficiently mixed with the mixture to form a material in a humid state. This material was supplied uniformly, through a sieve having sieve openings of about 5 mm×5 mm, to a metal flask having inside dimensions of 500×500 mm. Then the material in the flask was compressed under a pressure per unit area of 50 kg/cm$^2$ and was kept in this compressed state for 10 minutes to harden the binder and obtain a molded body (mold material) having external dimensions of 500×500 mm and a thickness of 100 mm. The molded body (mold material) was processed by a-milling machine. Then the surface of the body was polished with sandpaper to form a vacuum-forming mold, to produce a keyboard dust cover.

Since this vacuum-forming mold was excellent in air permeability, fineness, strength, and thermal conductivity properties, even though it had sharp angles and small ribs, even after ten thousand shots were produced from the mold molded products with all satisfactory small parts were continuously obtained at high speed and the products did not have any broken angle or rib.

EXAMPLE 2

Below an example of forming a transferring mold for preparing a surface cover by vacuum forming will be explained.

10 parts by weight of a modified diamine (UX-1026A, produced by Ace-Kaken Co., Ltd.) was added as the binder to, and mixed with, as the aggregate, 100 parts by weight of aluminum powders having a grain size distribution of 325 to 65 mesh. 5 parts by weight of a modified M. D. I. (UX-1026B, prepared by Ace-Kaken Co. Ltd.) was sufficiently mixed with the mixture to form a material in a humid state. This material was supplied through a sieve to a pattern mold 3 having a molding flask 2, said pattern mold being constituted with a smooth surface 4 having a curve of a large radius, on a part of which surface small concave letters, such as a company's name, were present. Then the material in the pattern mold was compressed under a pressure per unit area of 30 kg/cm$^2$ and was kept in this compressed state for 10 minutes to harden the binder and to obtain a molded body (transferring mold), shown as D in FIG. 2. The thus-obtained molded body (transferring mold) D has the following characteristics: (1) the surface of the mold has almost the same smoothness as that of the surface of the pattern mold; (2) it has a strength and air permeability sufficient for conducting vacuum forming; (3) it has a sufficient heat-resistance (it is never deformed, the hardened binder never deteriorates, and the aggregate ingredients never fall off to roughen the surface of the molded body) when it is heated (for example, to about 130° C.) to improve moldability, or, when it is used to mold a sheet, which has a high molding temperature (high heat-softening temperature) and a great heat capacity (having a great thickness).

In a like manner four molded bodies (transferring molds) of the same shape were prepared by using one pattern mold 3. Where necessary the outer periphery and the bottom surface were processed. The obtained molded bodies were combined and set up to form one large mold for vacuum forming. When vacuum forming was conducted by using this mold, a molded product was produced having smooth surfaces and without any residual air caused by poor suction. Also, a satisfactory vacuum-formed product was obtained in which small letters, such as a company's name, on the surface, were beautifully formed.

A plural number of molds having the same shape can be prepared by the above transfer method. One processing step was sufficient, when a pattern mold was prepared, to shape the surface of the pattern mold. Thus the cost to prepare molds was significantly decreased compared with when the surface of a mold was prepared from a mold material.

DETAILED DESCRIPTION OF THE DRAWINGS

Figure 1:
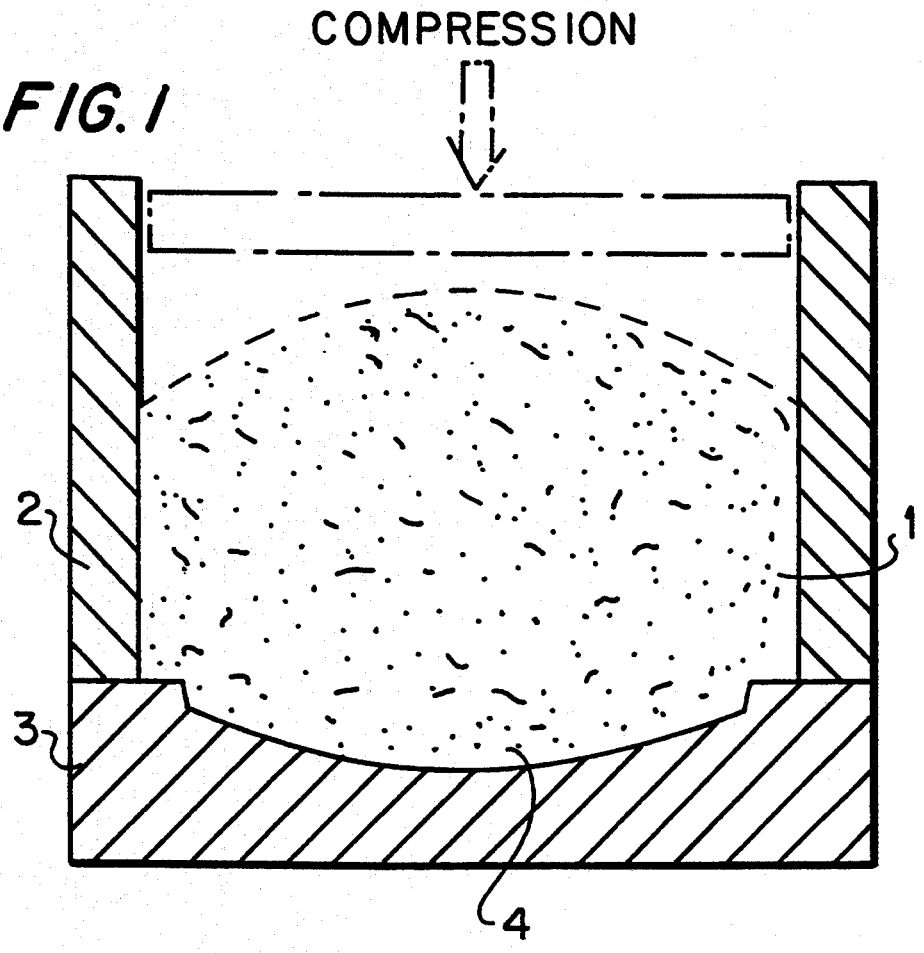
FIG. 1 is a sectional view that shows the state in which the molded body was prepared in Example 2. 1 in the Figure shows a material in a humid state. 2 shows a molding flask. 3 shows a pattern mold. 4 shows a smooth surface having a curve of a large radius.
Figure 2:
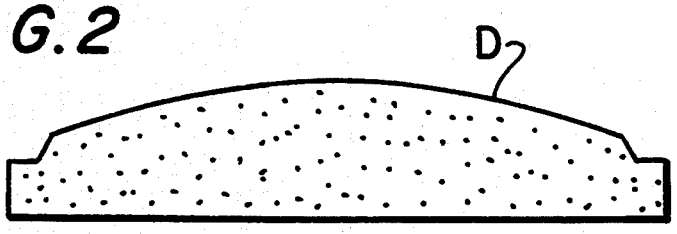
FIG. 2 is a sectional view of the molded body prepared by Example 2. D shows a molded body.

We claim:

1. A method of preparing an air-permeable molded body characterized by compounding 5–20 parts by weight of a binder consisting of a modified diamine and a modified M. D. I. that are both liquid with 100 parts by weight of an aggregate consisting of aluminum powders or aluminum-alloy powders having a grain size distribution of 325 to 48 mesh, mixing the compound, filling a molding flask with the mixture, compressing the packed mixture under a pressure per unit area of 20–80 kg/cm$^2$ and maintaining the mixture under the compressed state to harden the binder, and thereby obtaining a porous body having many fine and contiguous pores throughout it.

* * * * *